US006637519B2

(12) United States Patent
Miyano

(10) Patent No.: US 6,637,519 B2
(45) Date of Patent: Oct. 28, 2003

(54) SYSTEM AND METHOD FOR EXTINGUISHING A FIRE

(76) Inventor: Toshiharu Tom Miyano, 50 Dundee La., Barrington Hills, IL (US) 60010

( * ) Notice: Subject to any disclaimer, the term of this patent is extended or adjusted under 35 U.S.C. 154(b) by 0 days.

(21) Appl. No.: 09/950,251

(22) Filed: Sep. 10, 2001

(65) Prior Publication Data

US 2003/0047326 A1 Mar. 13, 2003

(51) Int. Cl.[7] ..... A62C 2/00; A62C 3/00

(52) U.S. Cl. ..... 169/46; 169/56; 169/57; 169/59; 169/60; 169/5; 169/19; 169/20

(58) Field of Search ..... 169/46, 56, 57, 169/59, 60, 5, 6, 8, 19, 20

(56) References Cited

U.S. PATENT DOCUMENTS 4,356,868 A * 11/1982 Bentley et al. ..... 118/629
4,691,783 A * 9/1987 Stern et al. ..... 169/19
5,449,041 A * 9/1995 Galbraith ..... 169/61
6,257,340 B1 * 7/2001 Vician ..... 169/11
6,390,203 B1 * 5/2002 Borisov et al. ..... 169/60

* cited by examiner

*Primary Examiner*—Robin O. Evans
(74) *Attorney, Agent, or Firm*—Wood, Phillips, Katz, Clark & Mortimer

(57) ABSTRACT

A system and method for extinguishing or controlling a fire. The system has a source of a substance which is usable to extinguish a fire in a prescribed area, a control system, and an activation system. The control system has (a) a first state in which the substance from the source is prevented from being released to the prescribed area and (b) a second state wherein the substance from the source is permitted to be released to the prescribed area to extinguish or control a fire at or adjacent to the prescribed area. The activation system has a first ignition element which ignites in response to exposure to at least one of (a) a flame, (b) heat above a predetermined temperature, and (c) a product of combustion. The control system is changeable from the first state into the second state an incident of the first ignition element being ignited.

10 Claims, 2 Drawing Sheets

SYSTEM AND METHOD FOR EXTINGUISHING A FIRE

BACKGROUND OF THE INVENTION

1. Field of the Invention

This invention relates to a system and method for automatically extinguishing or controlling a fire which is burning in a prescribed area.

2. Background Art

In many environments, systems have been designed for automatically extinguishing or controlling a fire that may be inadvertently started. One such system will be described below with respect to an exemplary environment.

As shown in FIG. 1, a system for extinguishing a fire is shown at 10 in association with a machine tool 12, which may have any of a multitude of different constructions and capabilities. The machine tool 12 operates in a prescribed area in which a fire may be inadvertently started during normal machining operations. Typically, rooms in which the machine tool 12 is operated utilize venting systems 14 which direct oil, water particles, and other matter entrained in the air within a machining space, to an appropriate location for collection or discharge. The venting system 14, while enhancing the environment around the machine tool 12 for human occupation, also vents the region around the machine tool 12 so as to contribute to the spread of any fire that may have started.

The function of the system 10 is threefold. First, the system 10 causes an extinguishing substance, in this case shown as $CO_2$ contained at a source 16, to be directed at the fire. Secondly, the system 10 closes the venting system 14 so as not to facilitate fire propagation. Finally, the system 10 causes the machine tool 12 to be shut down.

To effect the above three functions, one conventional system utilizes a sensor 18 to detect the presence of smoke or fire. The sensor 18 may take any of myriad different forms known to those skilled in the art. Upon detecting either smoke or fire, the sensor 18 sends a signal to a central controller 20, which coordinates operation of the machine tool 12, the venting system 14, and a valve 22, which selectively releases the $CO_2$ from the source 16. The controller 20 effects shutdown of the machine tool 12 and venting system 14, and operates the valve 22, through an electrical circuit 24.

While systems, such as that shown at 10 in FIG. 1, have been generally effective, systems of this type that rely on electrical circuitry may be prone to malfunction by reason of either their complexity or their sensitivity to heat or contamination generated during a fire. The machine tool industry, as well as other industries, is constantly seeking new and better ways to control inadvertently started fires in this type of environment.

SUMMARY OF THE INVENTION

In one form, the invention is directed to a system for extinguishing a fire. The system has a source of a substance which is usable to extinguish or control a fire in a prescribed area, a control system, and an activation system. The control system has (a) a first state in which the substance from the source is prevented from being released to the prescribed area and (b) a second state wherein the substance from the source is permitted to be released to the prescribed area to extinguish or control a fire at or adjacent to the prescribed area. The activation system has a first ignition element which ignites in response to exposure to at least one of (a) a flame, (b) heat above a predetermined temperature, and (c) a product of combustion. The control system is changeable from the first state into the second state an incident of the ignition element being ignited.

In one form, there is no electrical circuitry which is responsible for changing the control system from the first state into the second state.

In one form, the control system consists of a pressure responsive switch which changes from a normal state into an activated state as an incident of the first ignition element being ignited. The control system is in the first state with the pressure responsive switch in the normal state and in the second state with the pressure responsive switch in the activated state.

In one form, there is a conduit which has a passageway in which pressure is generated in response to ignition of the first ignition element and which causes the pressure responsive switch to change from the normal state into the activated state.

A shutoff may be provided for selectively blocking the passageway between the first ignition element and pressure responsive switch to disable the activation system.

The system may further include a second ignition element which is ignited as an incident of the first ignition element being ignited.

The ignition of the second ignition element causes the control system to change from the first state into the second state.

In one form, the substance used to extinguish or control the fire is $CO_2$.

The system may include an operable system component in addition to the control system and having an operating state and a disabled state, a deactivation system, and a second ignition element which is ignited in response to ignition of the first ignition element to cause the deactivation system to change from a normal state into a deactivation state. The operable system component changes from the operating state into the disabled state as an incident of the deactivation system changing form the normal state into the deactivation state. This same function may be effected without the requirement for the second ignition element.

In one form, the operable system component is one of a machine tool and a venting system for atmospheric air in the vicinity of the prescribed area.

The venting system may have an associated damper which is changeable between open and closed states. The damper is in the open state with the venting system in the operating state and in the closed state with the venting system in the disabled state.

The ignition element may include an explosive component.

The invention is also directed to a method of extinguishing a fire in a prescribed area. The method includes the steps of: situating a first ignition element in the vicinity of the prescribed area; in response to exposure of the first ignition element to at least of (a) a flame, (b) heat above a predetermined temperature, and (c) a product of combustion, causing the first ignition element to ignite; and in response to ignition of the first ignition element causing a control system to release a substance from a source of the substance to the prescribed area to extinguish or control a fire in the prescribed area.

The method may further include the step of changing an operable system component in addition to the control system from an operating state into a disabled state in response to ignition of the first ignition element.

The operable system component may be one of (a) a machine tool for performing a processing operation on a workpiece and (b) a venting system for atmospheric air in the vicinity of the prescribed area.

The method may further include the step of causing the first ignition element to ignite a second ignition element. The ignition of the second ignition element causes the control system to release the substance to the prescribed area to extinguish or control a fire in the prescribed area.

The first ignition element may ignite a second ignition element so that the second ignition element causes the operable system component to change from the operating state into the disabled state.

The first ignition element may include an explosive component.

The substance used to extinguish or control the fire may be $CO_2$.

DETAILED DESCRIPTION OF THE DRAWINGS

Figure 2:
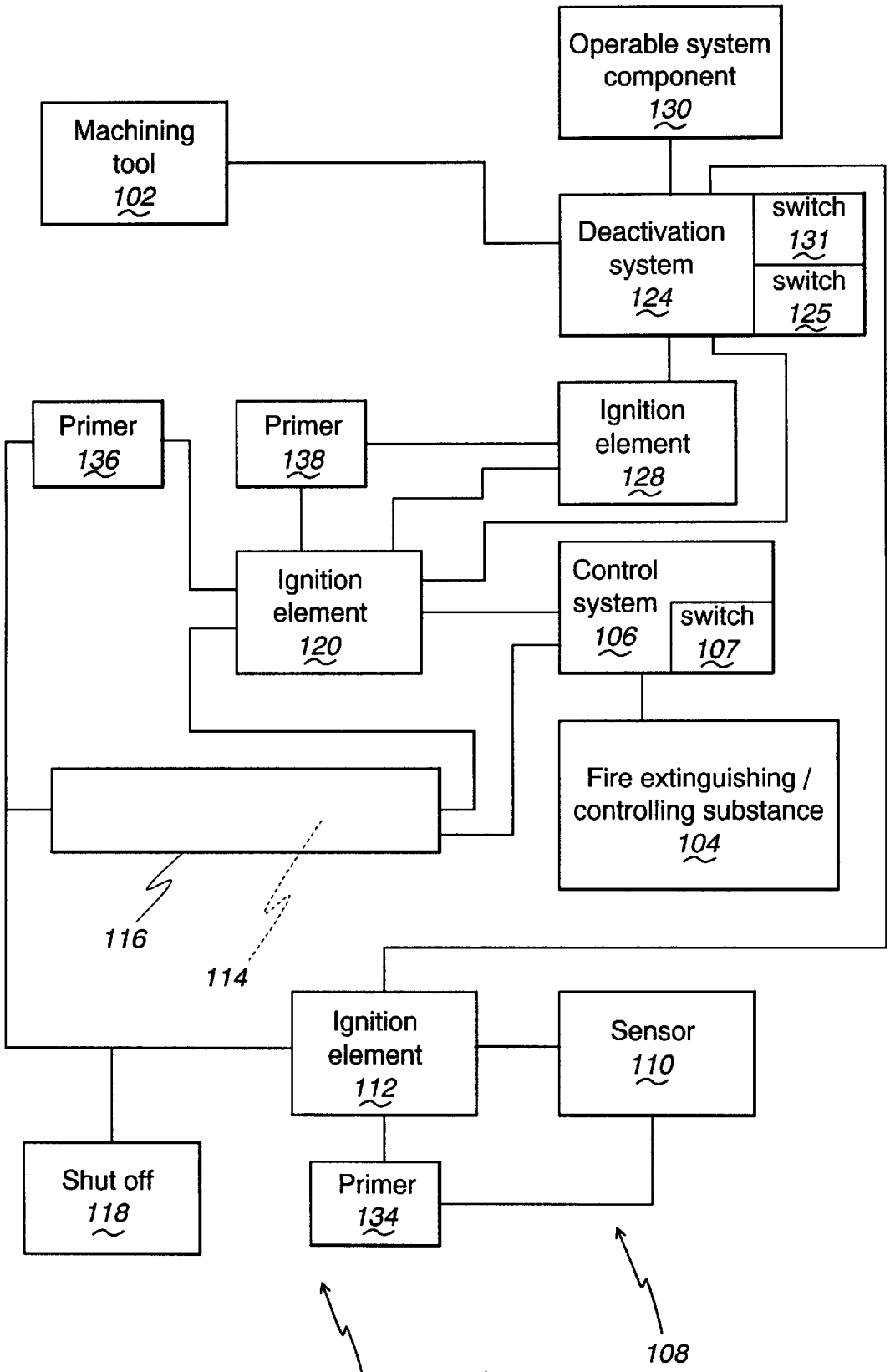
FIG. 2 is a schematic representation of a system for extinguishing fire in a machine tool environment according to the present invention.

One system for extinguishing a fire, according to the present invention, is shown at 100 in FIG. 2. The system 100 is shown in a machining environment with an operable component in the form of a machine tool 102. It should be understood that the inventive system 100 can be used in virtually any environment wherein automatic fire extinguishing or controlling capability is desired, with the machine tool environment used herein only for purposes of illustration.

The system 100 is designed to cause the discharge of a fire extinguishing/controlling substance from a source 104 in a prescribed area around the machine tool 102. The fire extinguishing substance at the source 104 may be any substance commonly used for this purpose. $CO_2$ is commonly used in this environment.

The substance in the source 104 is selectively releasable through operation of a control system 106. The control system 106 has a first state in which the fire extinguishing/controlling substance from the source 104 is prevented from being released to the prescribed area and a second state wherein the substance from the source 104 is permitted to be released to the prescribed area to extinguish or control a fire at or adjacent to the prescribed area. In this embodiment, the control system incorporates a pressure responsive switch 107 which has a normal state with the control system in the first state and an activated state with the control system in the second state.

The system 100 has an activation system 108 which is responsible for changing the switch 107 from the normal state into the activated state, and thereby the control system 106 from the first state into the second state. In its simplest form, the activation system 108 consists of a sensor 110 and an ignition element 112. The sensor 110 may be part of the ignition element 112 and is responsible for causing the ignition element 112 to ignite upon exposure of the sensor 10 to at least one of a flame, heat above a predetermined temperature, and a product of combustion. Alternatively, the sensor 110 may be a separate element designed to react in response to exposure to a flame, heat, or a product of combustion to produce an ignition stimulus to the ignition element 112. The ignition element 112 may be made in replaceable cartridge form so that the activation system 108 may be deployed and thereafter set up again for reuse.

The sensor 110, which functions as described above, may be made in any of a multitude of different forms. Those skilled in the art are familiar with sensors 110 capable of detecting fire, or imminent fire indicators, to initiate the extinguishing process.

The ignition element 112, in response to being ignited, produces a stimulus to change the switch 107 from the normal state into the activated state and thereby the control system 106 from the first state into the second state. In one form, the ignition element 112 includes an explosive component, such as gunpowder, which, upon being ignited, produces a pressure rise or shock. In the embodiment shown, pressure from the ignition of the ignition element 112 is generated in a passageway 114 of a conduit 116 so that the increasing pressure is eventually caused, through the conduit 116, to be impinged upon the control system 106 to effect change thereof from the first state into the second state.

Many different types of pressure responsive switches can be used in the control system 106 to allow operation as described above. For example, the switch 107 may be a simple diaphragm, acting as a valve, that is repositioned under the pressure change resulting from the explosion to allow the change of state of the control system 106. As another example, the control system 106 may include an element which breaks or reconfigures in response to the increased pressure from the ignition/explosion of the ignition element 112, as an incident of which the control system 106 changes from the first state into the second state. As a further alternative, a spring-loaded repositionable element can be used. A movable, biased shutter may reposition in response to the pressure surge to change the state of the control system 106. Consequently, with the system 100 as described above, there is no need for any electrical circuitry to change the control system 106 from the first state into the second state therefor. The invention can be used as an alternative to an electrically operated control system or as a backup to such a system The activation system 108 can be selectively disabled by a shutoff 118, which may block the passageway 114, or communication of pressure from the ignition explosion to the passageway 114, to prevent a pressure build-up at the control system 106 sufficient to change the state thereof.

The ignition element 112 is described to be ignitible to directly change the state of the control system 106. As an alternative to this arrangement, or in conjunction therewith, a second ignition element 120 may be interposed between the ignition element 112 and the control system 106. The ignition element 120 may have the same general construction as the ignition element 112. The ignition element 120 is ignited by the ignition/explosion of the ignition element 112. This may effect a more positive operation of the control system 106 and provides a redundant pressure application to the control system 106 for reliable operation thereof.

In addition to discharging the fire extinguishing substance at the prescribed area in the vicinity of the machine tool 102, the system 100 is designed to additionally shut the machine tool 102 down from an operating state into a disabled state after a fire or fire precursor is detected at the sensor 110. This is accomplished through a deactivation system at 124. The deactivation system 124 may include a pressure responsive switch 125 that is changeable from a normal state into a deactivation state in response to the ignition of the ignition element 112. The ignition element 112 may directly and by itself operate the deactivation system 124. Alternatively, the ignition element 112 may cause ignition of the ignition element 120, which in turn ignites an ignition element 128 to effect the change of state of the deactivation system 124. The ignition element 128 may have the same construction as the ignition element 112. Alternatively, the ignition element 112 may directly produce pressure on the pressure sensitive switch 125 on the deactivation system 124 in conjunction with pressure from the ignition element 128 produced through the chain reaction from ignition of the ignition element 112 and in turn the ignition element 120 and ignition element 128.

The deactivation system 124 may be responsible for disabling another operable system component 130, such as the venting system 14, previously described. As noted, through the venting system 14, entrained liquid or solid particles, generated during the machining operations, may be conveyed through a pressure differential to an accumulation site or exhausted, as to the outside of a building. This venting system 14 also creates an environment more conducive to burning and it is thus desirable that the venting system 14 be changed from an open operating state into a closed disabled state. The deactivation system 124 may have a separate pressure sensitive switch 131 which responds to the ignition of the ignition element 112 alone, or ignition of the ignition element 112 and/or ignition element 128, to change the state of the operable system component 130.

Similarly, the deactivation system 124 can be designed to deactivate an operable system component 130 without any electrical circuitry between the sensor 110 and the deactivation system 124. The potential redundant pressure activation from the ignition elements 112,120,128 improves reliability even further.

Each ignition element 112,120,128 may be ignited through an optional intermediate primer 134,136,138, consecutively. The primers 134,136,138 may likewise be made in replaceable cartridge form.

Figure 1:
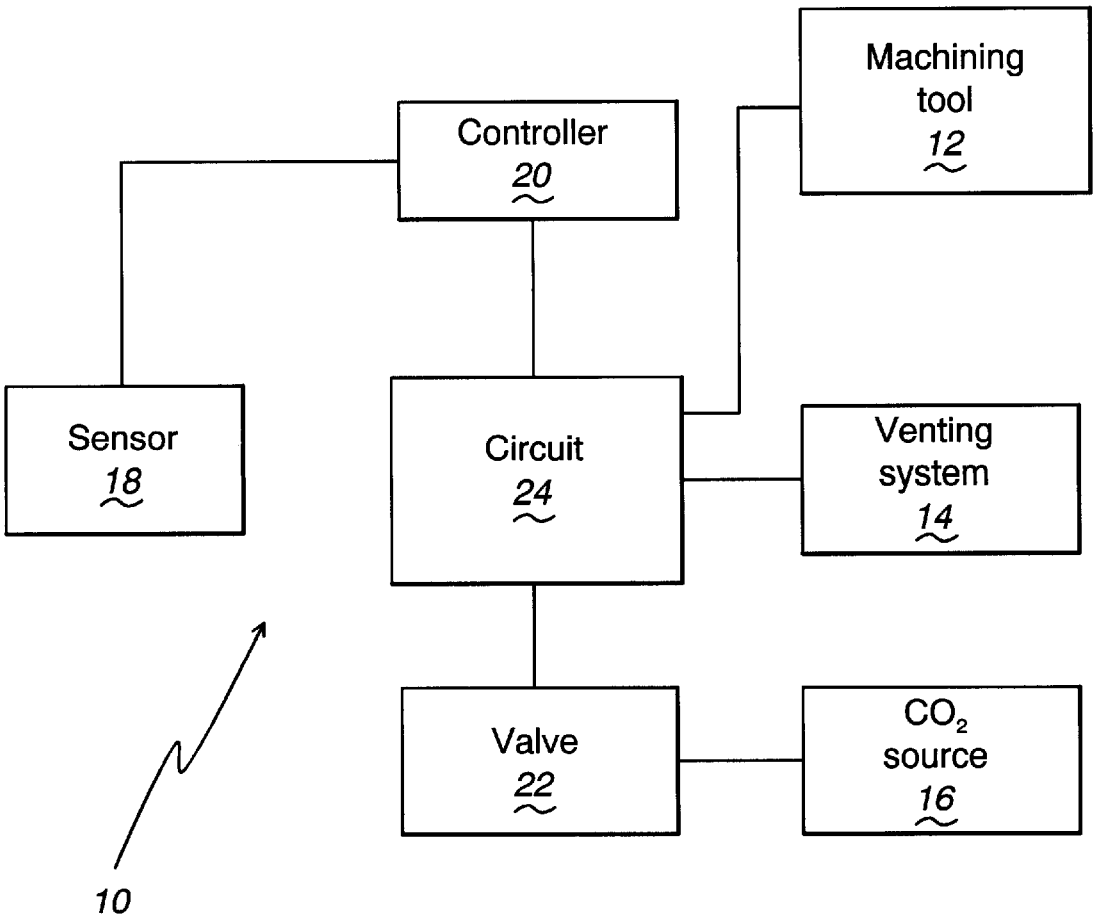
Fig. 1 (prior art)
FIG. 1 is a schematic representation of a prior art system for extinguishing fire in a machine tool environment.

In operation, once the sensor 110 detects either fire or a fire precursor, the ignition element 112 is caused to be ignited which causes, directly or indirectly, the change in the control system 106 from its first state into its second state. This allows the discharge of the $CO_2$, or other fire extinguishing substance 104, to the prescribed area around the machine tool 102. At the same time, the ignition of the ignition element 112 directly and/or indirectly causes the deactivation system 124 to change from the normal state into the deactivation state therefor which disables both the machine tool 102 and the other operable system component 130, which may be the venting system, such as a venting system 14 in FIG. 1. The pressure transmission at each critical point in the system 10 may be effected using conduits defining passageways, such as the conduit 116 defining the passageway 114, or by any other means known to those skilled in this art.

While the invention has been described with particular reference to the drawings, it should be understood that various modifications could be made without departing from the spirit and scope of the present invention.

What is claimed is:

1. A system for extinguishing a fire, the system comprising:

a source of a substance which is usable to extinguish a fire in a prescribed area;

a control system which has (a) a first state in which the substance from the source is prevented from being released to the prescribed area and (b) a second state wherein the substance from the source is permitted to be released to the prescribed area to extinguish or control a fire at or adjacent to the prescribed area; and an activation system comprising a first ignition element which ignites in response to exposure to at least one of (a) a flame, (b) heat above a predetermined temperature, and (c) a product of combustion, the control system changeable from the first state into the second state as an incident of the ignition element being ignited, wherein there is a conduit which has a passageway in which pressure is generated by ignition of the first ignition element and which causes the pressure responsive switch to change from the normal state into the activated state; and a shutoff for selectively blocking the passageway between the first ignition element and pressure responsive switch to disable the activation system.

2. A system for extinguishing a fire, the system comprising:

a source of a substance which is usable to extinguish a fire in a prescribed area;

a control system which has (a) a first state in which the substance from the source is prevented from being released to the prescribed area and (b) a second state wherein the substance from the source is permitted to be released to the prescribed area to extinguish or control a fire at or adjacent to the prescribed area;

an activation system comprising a first ignition element which ignites in response to exposure to at least one of (a) a flame, (b) heat above a predetermined temperature, and (c) a product of combustion, the control system changeable from the first state into the second state as an incident of the ignition element being ignited; and a second ignition element which is ignited as an incident of the first ignition element being ignited, the ignition of the second ignition element causing the control system to change from the first state into the second state.

3. A system for extinguishing a fire, the system comprising:

a source of a substance which is usable to extinguish a fire in a prescribed area;

a control system which has (a) a first state in which the substance from the source is prevented from being released to the prescribed area and (b) a second state wherein the substance from the source is permitted to be released to the prescribed area to extinguish or control a fire at or adjacent to the prescribed area;

an activation system comprising a first ignition element which ignites in response to exposure to at least one of (a) a flame, (b) heat above a predetermined temperature, and (c) a product of combustion, the control system changeable from the first state into the second state as an incident of the ignition element being ignited; and an operable system component in addition to the control system and having an operating state and a disabled state, a deactivation system, and a second ignition element which is ignited in response to ignition of the first ignition element to cause the deactivation system to change from a normal state into a deactivation state, the operable system component changing from the operating state into the disabled state as n incident of the deactivation system changing from the normal state into the deactivation state.

4. A system for extinguishing afire, the system comprising:

a source of a substance which is usable to extinguish a fire in a prescribed area;

a control system which has (a) a first state in which the substance from the source is prevented from being released to the prescribed area and (b) a second state wherein the substance from the source is permitted to be released to the prescribed area to extinguish or control a fire at or adjacent to the prescribed area;

an activation system comprising a first ignition element which ignites in response to exposure to at least one of (a) a flame, (b) heat above a predetermined temperature, and (c) a product of combustion, the control system changeable from the first state into the second state as an incident of the ignition element being ignited;

an operable system component in addition to the control system and having an operating state and a disabled state, and a deactivation system, ignition of the first ignition element causing the deactivation system to change from a normal state into a deactivation state, the operable system component changing from the operating state into the disabled state as an incident of the deactivation system changing from the normal state into the deactivation state.

5. The system for extinguishing a fire according to claim 4 wherein the operable system component comprises a machine tool for performing a processing operation on a workpiece.

6. The system for extinguishing a fire according to claim 4 wherein the operable system component comprises a venting system for atmospheric air in the vicinity of the prescribed area.

7. The system for extinguishing a fire according to claim 6 wherein the venting system has an associated damper which is changeable between open and closed states, the damper being in the open state with the venting system in the operating state and in the closed stated with the venting system in the disabled state.

8. A method of extinguishing a fire in a prescribed area, the method comprising the steps of:

situating a first ignition element in the vicinity of the prescribed area;

in response to exposure of the first ignition element to at least one of (a) a flame, (b) heat above a predetermined temperature, and (c) a product of combustion, causing the first ignition element to ignite;

in response to ignition of the first ignition element causing a control system to release a substance from a source of the substance to the prescribed area to extinguish or control a fire in the prescribed area; and changing an operable system component in addition to the control system from an operating state into a disabled state in response to ignition of the first ignition element.

9. The method of extinguishing a fire according to claim 8 wherein the operable system component comprises one of (a) a machine tool for performing a processing operation on a workpiece and (b) a venting system for atmospheric air in the vicinity of the prescribed area.

10. The method of extinguishing a fire according to claim 8 further comprising the step of causing the first ignition element to ignite a second ignition element, the ignition of the second ignition element causing the operable system component to change from the operating state into the disabled state.

* * * * *